US008144087B2

(12) United States Patent
Lee

(10) Patent No.: US 8,144,087 B2
(45) **Date of Patent: *Mar. 27, 2012**

(54) COLOR LED DRIVER

(75) Inventor: Dong Woo Lee, Gyunggi-Do (KR)

(73) Assignee: Samsung LED Co., Ltd., Gyunggi-do (KR)

( * ) Notice: Subject to any disclaimer, the term of this patent is extended or adjusted under 35 U.S.C. 154(b) by 0 days.

This patent is subject to a terminal disclaimer.

(21) Appl. No.: 12/891,272

(22) Filed: Sep. 27, 2010

(65) Prior Publication Data

US 2011/0012533 A1 Jan. 20, 2011

Related U.S. Application Data

(62) Division of application No. 11/657,064, filed on Jan. 24, 2007, now Pat. No. 7,872,621.

(30) Foreign Application Priority Data

Jan. 24, 2006 (KR) ..... 10-2006-0007459

(51) Int. Cl.
*G09G 3/32* (2006.01)

(52) U.S. Cl. ..... 345/82; 345/102

(58) Field of Classification Search ..... 345/82, 345/98–102

See application file for complete search history.

(56) References Cited

U.S. PATENT DOCUMENTS 6,242,870 B1 6/2001 Koyanagi et al.
6,690,146 B2 2/2004 Burgyan et al.
6,747,617 B1 6/2004 Kawashima (Continued)

FOREIGN PATENT DOCUMENTS

EP 1 672 706 A1 6/2006

(Continued)

OTHER PUBLICATIONS

Korean Office Action, with English Translation, issued in Korean Patent Application No. KR 10-2006-0007459, mailed on Apr. 23, 2007.

(Continued)

*Primary Examiner* — Richard Hjerpe
*Assistant Examiner* — Sahlu Okebato
(74) *Attorney, Agent, or Firm* — McDermott Will & Emery LLP

(57) ABSTRACT

Disclosed herein is a color LED driver, which is capable of being implemented by a compact structure without a feedback structure and accompanying a small size and low cost, by directly connecting a negative temperature coefficient (NTC) thermistor to a driving current path of a color LED applied to an LCD backlight to compensate a characteristic variation of the LED due to a variation in a temperature. The color LED driver includes a driving constant voltage source 100 which supplies a predetermined driving constant voltage VD; a driving circuit 200 which converts the driving constant voltage VD of the driving constant voltage source 100 into a plurality of driving currents, for driving color LEDs, the plurality of driving currents including red LED driving current Ird, green LED driving current Igd and blue LED driving current Ibd; a temperature compensation unit 300 which compensates variations in the red LED driving current Ird and the green LED driving current Igd due to a variation in a temperature, among the plurality of driving currents from the driving circuit 200; and an LED unit 400 including a plurality of color LEDs which are turned on by the driving currents from the temperature compensation circuit 300 and the driving current from the driving circuit 200.

7 Claims, 5 Drawing Sheets

U.S. PATENT DOCUMENTS

| | | | | |
|---|---|---|---|---|
| 6,888,529 | B2 * | 5/2005 | Bruning et al. | 345/102 |
| 7,144,130 | B2 | 12/2006 | Toyota et al. | |
| 7,330,002 | B2 | 2/2008 | Joung, II | |
| 2002/0070914 | A1 * | 6/2002 | Bruning et al. | 345/102 |
| 2006/0109389 | A1 * | 5/2006 | Ichikawa et al. | 349/1 |
| 2007/0080905 | A1 * | 4/2007 | Takahara | 345/76 |
| 2007/0120496 | A1 | 5/2007 | Shimizu et al. | |

FOREIGN PATENT DOCUMENTS

| | | |
|---|---|---|
| JP | 11-298044 | 10/1999 |
| JP | 2001-287398 | 10/2001 |
| JP | 2002-237645 | 8/2002 |
| JP | 2004-515891 | 5/2004 |
| JP | 2006-135007 | 5/2006 |
| JP | 2006-237282 | 9/2006 |
| JP | 2007-095291 | 4/2007 |
| JP | 2007-134194 | 5/2007 |
| JP | 2007-165632 | 6/2007 |
| JP | 2009-514206 | 4/2009 |
| WO | WO 02/47438 A2 | 6/2002 |
| WO | WO 2005/011006 A1 | 2/2005 |
| WO | WO 2006/006537 A1 | 1/2006 |
| WO | WO 2007/049180 A1 | 5/2007 |

OTHER PUBLICATIONS

Japanese Office Action, w/ English translation thereof, issued in Japanese Patent Application No. 2007-013585, dated Jun. 28, 2011.

Taiwanese Office Action, with English translation, issued in Taiwanese Patent Application No. 096102437, dated Jan. 12, 2012.

* cited by examiner (a)

(b)

COLOR LED DRIVER

RELATED APPLICATIONS

This application is a Divisional of U.S. patent application Ser. No. 11/657,064, filed on Jan. 24, 2007, now U.S. Pat. No. 7,872,621 claiming priority of Korean Patent Application No. 10-2006-0007459, filed on Jan. 24, 2006, the entire contents of each of which are hereby incorporated by reference.

BACKGROUND OF THE INVENTION

1. Field of the Invention

The present invention relates to a color light-emitting diode (LED) driver of an LCD backlight, and more particularly, to a color LED driver, which is capable of being implemented by a compact structure without a feedback structure and accompanying a small size and low cost, by directly connecting a negative temperature coefficient (NTC) thermistor to a driving current path of a color LED applied to an LCD backlight to compensate a characteristic variation of the LED due to a variation in a temperature.

2. Description of the Related Art

Generally, a white LED has been widely used in a mobile device as a light source of a LCD backlight. In a middle-sized or large-sized LCD backlight, a backlight having LEDs of red, green and blue has been developed in order to improve color reproduction. In addition, in order to obtain the same effect, a RGB-LED backlight for a mobile device is being developed.

However, in order to use the RGB LEDs in the mobile device, a light-emitting characteristic deviation according to a temperature needs to be compensated with low cost.

Generally, in a relationship between an ambient temperature and a relative luminance of the LEDs of red, green and blue, when the ambient temperature gradually increases during the operation of the LEDs, light outputs of the RGB LEDs gradually decrease from initial setting values in order of the red LED, the green LED and the blue LED.

However, when the white LED is used in the backlight, the efficiency of the LED decreases as the temperature increases. Accordingly, a luminance decreasing phenomenon occurs, but a color coordinate shift phenomenon hardly occurs. As a result, a temperature compensation circuit is hardly used in the backlight for the mobile device.

In a backlight unit (BLU) using the RGB LEDs, since the luminance decreasing phenomenon and the color coordinate shift phenomenon occur as the ambient temperature increases, the color tends to be shifted to blue, compared with an initial setting state. Accordingly, in the LCD backlight using the RGB LEDs, as described above, a temperature compensation unit for compensating the light outputs of the RGB LEDs which are reduced according to the variation in a temperature and uniformly maintaining the light outputs over time is required, unlike the white LED.

FIG. 1 is a view showing the configuration of a conventional color LED driver.

The conventional color LED driver shown in FIG. 1 includes a driving voltage source 10 for supplying a predetermined driving constant voltage (VD), a driving circuit 20 for converting the driving constant voltage VD of the driving voltage source 10 into red LED driving current Ird, green LED driving current Igd and blue LED driving current Ibd, for driving the color LEDs, and an LED unit 30 including a plurality of color LEDs which are turned on by the red LED driving current Ird, the green LED driving current Igd and the blue LED driving current Ibd from the driving circuit 20.

The LED unit 30 includes a red LED unit 31 including a plurality of red LEDs, a green LED unit 31 including a plurality of green LEDs and a blue LED unit 33 including a plurality of blue LEDs.

In the conventional color LED driver, the brightness (luminance) varies depending on the ambient temperature, due to the LED characteristics. A variation in luminance due to the temperature is shown in FIG. 2.

FIG. 2 is a characteristic graph showing relationships between luminance and temperature of the color LEDs shown in FIG. 1.

Referring to FIG. 2, the luminance of the blue LED hardly varies depending on the variation in the temperature. However, the brightnesses (luminances) of the red LED and the green LED vary depending on the variation in the temperature, because a contact resistance value varies depending on the variation in the ambient temperature and driving current varies depending on the variation in the contact resistance value. Accordingly, the color is shifted to blue.

SUMMARY OF THE INVENTION

The present invention has been made to solve the foregoing problems of the prior art and therefore an aspect of the present invention is to provide a color LED driver, which is capable of being implemented by a compact structure without a feedback structure and accompanying a small size and low cost, by directly connecting a negative temperature coefficient (NTC) thermistor to a driving current path of a color LED applied to a LCD backlight to compensate a characteristic variation of the LED due to a variation in a temperature.

According to an aspect of the invention, the invention provides a color LED driver comprising: a driving constant voltage source for supplying a predetermined driving constant voltage; a driving circuit for converting the driving constant voltage of the driving constant voltage source into a plurality of driving currents, for driving color LEDs, the plurality of driving currents including red LED driving current, green LED driving current and blue LED driving current; a temperature compensation unit for compensating variations in the red LED driving current and the green LED driving current due to a variation in a temperature, among the plurality of driving currents from the driving circuit; and an LED unit including a plurality of color LEDs which are turned on by the driving currents from the temperature compensation circuit and the driving current from the driving circuit.

The temperature compensation unit may comprise an NTC thermistor for compensating the red LED driving current and the green LED driving current; and a linear compensation resistor which is connected to the NTC thermistor in parallel, for compensating linearity of the red LED driving current and the green LED driving current.

The temperature compensation unit may comprise a first temperature compensation circuit including a first NTC thermistor for compensating the red LED driving current according to the variation in the temperature and a first linear compensation resistor which is connected to the first NTC thermistor in parallel, for compensating linearity of the red LED driving current; and a second temperature compensation circuit including a second NTC thermistor for compensating the green LED driving current according to the variation in the temperature and a second linear compensation resistor which is connected to the second NTC thermistor in parallel, for compensating linearity of the green LED driving current.

The first NTC thermistor may have temperature sensitivity higher than that of the second NTC thermistor.

The LED unit may comprise a first LED unit including a plurality of color LEDs and driven by one driving current; a second LED unit including a plurality of color LEDs and driven by another driving current; and a third LED unit including a plurality of color LEDs and driven by the other driving current.

The first LED unit may include the plurality of red LEDs and is driven by the red LED driving current.

The second LED unit may include the plurality of green LEDs and is driven by the green LED driving current.

The third LED unit may include the plurality of blue LEDs and is driven by the blue LED driving current.

Each of the first, second and third LEDs may include at least two of a red LED, a green LED and a blue LED.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENTS

Preferred embodiments of the present invention will now be described in detail with reference to the accompanying drawings.

Figure 1:
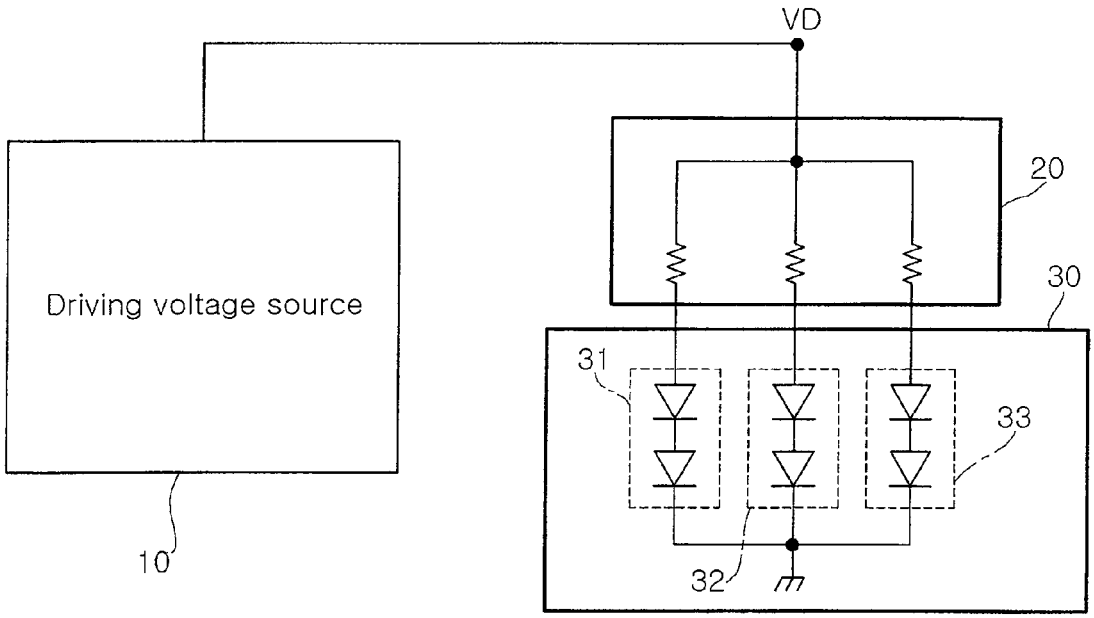
Prior art FIG. 1
FIG. 1 is a view showing the configuration of a conventional color LED driver.
Figure 2:
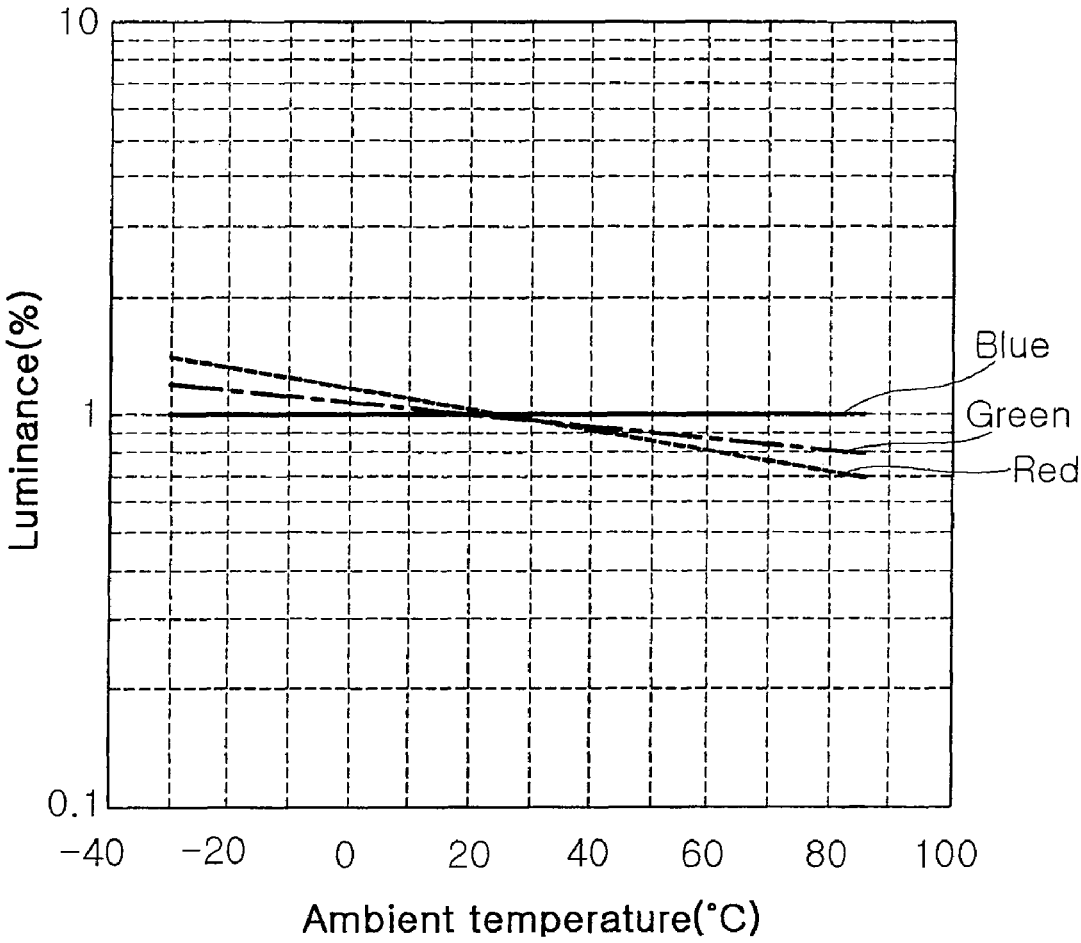
Prior art FIG. 2
FIG. 2 is a characteristic graph showing relationships between luminance and temperature of the color LEDs shown in FIG. 1.
Figure 3:
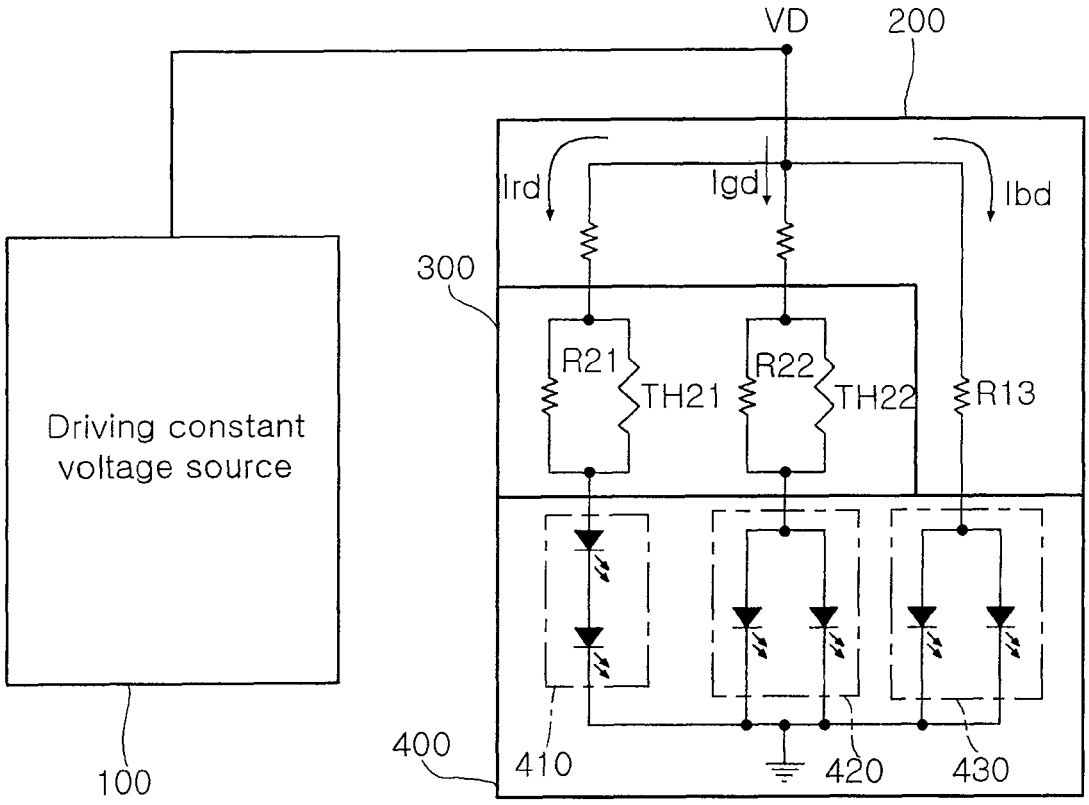
FIG. 3 is a view showing the configuration of a color LED driver according to the present invention.

FIG. 3 is a view showing the configuration of a color LED driver according to the present invention.

Referring to FIG. 3, the color LED driver according to the present invention includes a driving constant voltage source 100, a driving circuit 200, a temperature compensation unit 300 and an LED unit 400.

The driving constant voltage source 100 supplies a predetermined driving constant voltage VD to the driving circuit 200. Since the driving constant voltage VD is always a uniform voltage (e.g., 5V) regardless of load resistance, driving current can be adjusted by varying a resistor.

The driving circuit 200 converts the driving constant voltage VD of the driving constant voltage source 100 into a plurality of driving currents, for driving the color LEDs. Here, the plurality of driving currents includes red LED driving current Ird, green LED driving current Igd and blue LED driving current Ibd.

The temperature compensation unit 300 compensates variations in the red LED driving current Ird and the green LED driving current Igd due to a variation in a temperature, among the plurality of driving currents from the driving circuit 200.

The LED unit 400 includes a plurality of color LEDs which are turned on by the driving currents from the temperature compensation unit 300 and the driving current from the driving circuit 200.

The LED unit 400 includes a first LED unit 410 including a plurality of color LEDs driven by one driving current, a second LED unit 420 including a plurality of color LEDs driven by another driving current, and a third LED unit 430 including a plurality of color LEDs driven by the other driving current.

The first LED unit 410 includes a plurality of red LEDs and is driven by the red LED driving current Ird. The second LED unit 420 includes a plurality of green LEDs and is driven by the green LED driving current Igd. The third LED unit 430 includes a plurality of blue LEDs and is driven by the blue LED driving current Ibd.

Each of the first, second and third LED units 410, 420 and 430 may include at least two of the red LED, the green LED and the blue LED.

The plurality of red LEDs, the plurality of green LEDs and the plurality of blue LEDs may connected to each other in series or/and in parallel. For example, when any one of the first, second and third LED units 410, 420 and 430 includes the red LED and the blue LED, the LED unit may be driven by the red LED driving current Ird.

The first, second and third LED units 410, 420 and 430 of the LED unit 400 according to the present invention may be configured by a combination of a variety of colors.

FIGS. 4*a* and 4*b* are views showing examples of a temperature compensation circuit shown in FIG. 3.

Referring to FIG. 4*a*, the temperature compensation unit 300 includes an NTC thermistor TH20 for compensating the red LED driving current Ird and the green LED driving current Igd according to a variation in a temperature and a linear compensation resistor R20 connected to the NTC thermistor TH20 in parallel, for compensating linearities of the red LED driving current Ird and the green LED driving current Igd. Here, the NTC thermistor has a negative temperature coefficient characteristic that a resistance value decreases as the temperature increases.

Referring to FIG. 4*b*, the temperature compensation unit 300 includes a first temperature compensation circuit 310 and a second temperature compensation circuit 320.

The first temperature compensation circuit 310 includes a first NTC thermistor TH21 for compensating the red LED driving current Ird according to the variation in the temperature and a first linear compensation resistor R21 connected to the first NTC thermistor TH21 in parallel, for compensating linearity of the red LED driving current Ird.

The second temperature compensation circuit 320 includes a second NTC thermistor TH22 for compensating the green LED driving current Igd according to the variation in the temperature and a second linear compensation resistor R22 connected to the second NTC thermistor TH22 in parallel, for compensating linearity of the green LED driving current Igd.

It is preferable that the first NTC thermistor TH21 has temperature sensitivity higher than that of the second NTC thermistor TH22 in consideration that the red LED is more sensitive to the temperature than the green LED.

FIGS. 5*a* and 5*b* are characteristic graphs showing a relationship between luminance and temperature and a relationship between driving current and temperature of the color LED driver according to the present invention, respectively.

Hereinafter, the operation and the effect of the present invention will be described in detail with the accompanying drawings.

Figure 4:
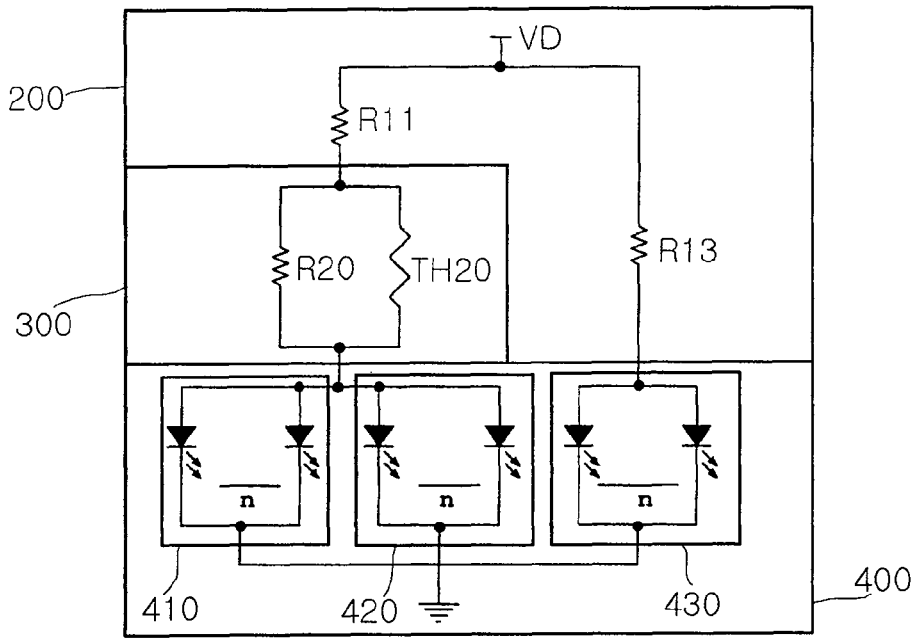
FIGS. 4*a* and 4*b* are views showing examples of a temperature compensation circuit shown in FIG. 3.
Figure 4:
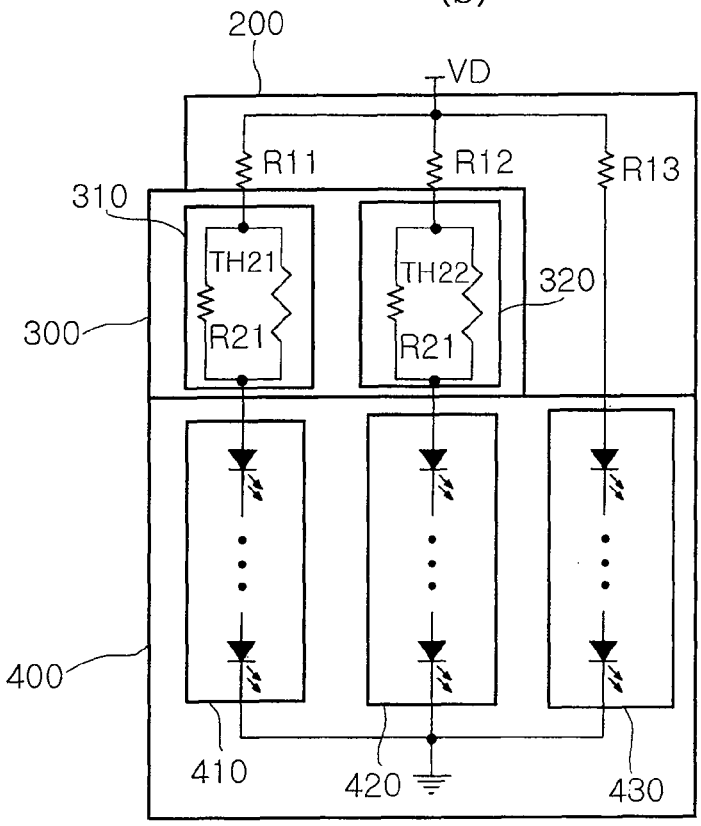
Figure 5:
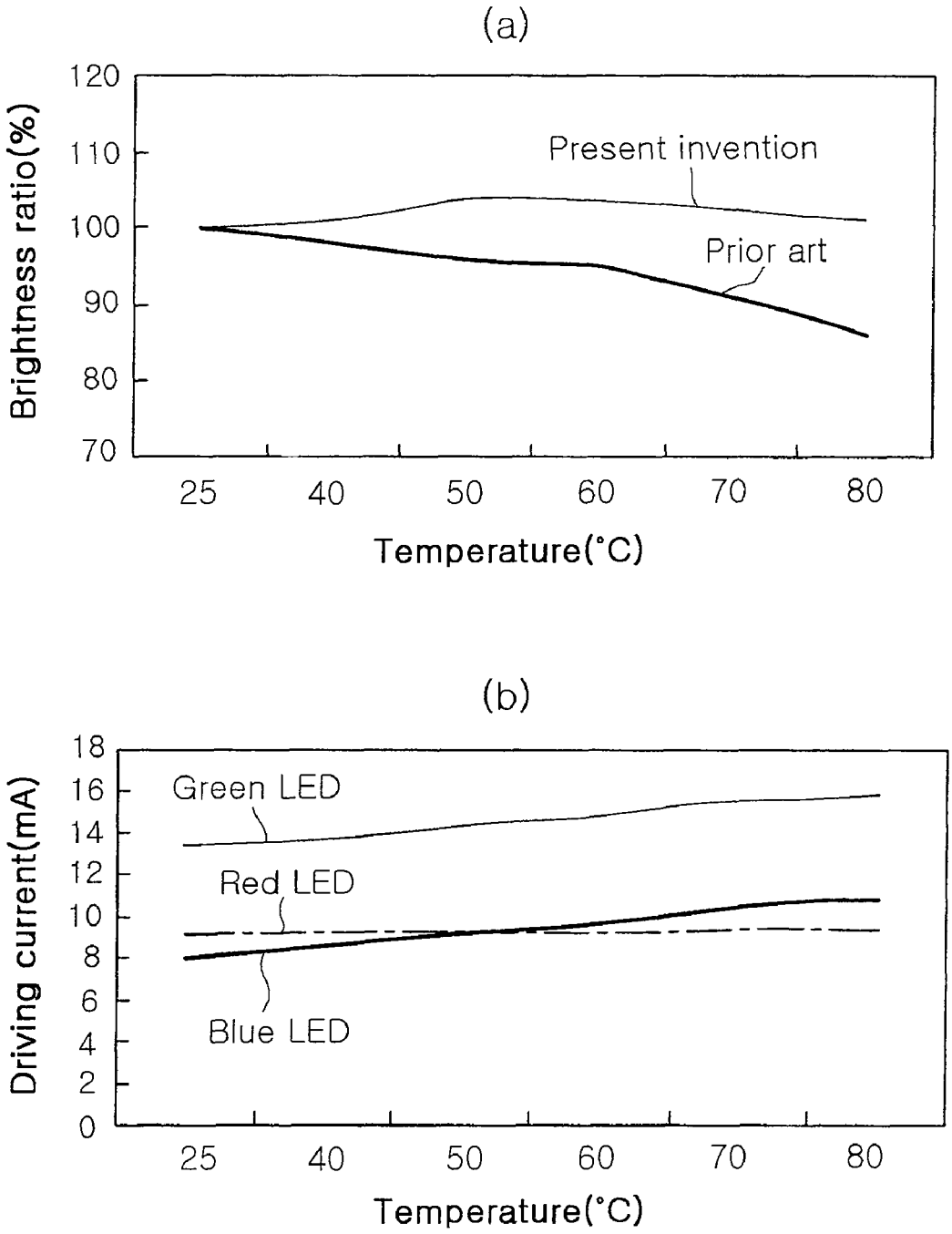
FIGS. 5*a* and 5*b* are characteristic graphs showing a relationship between luminance and temperature and a relationship between driving current and temperature of the color LED driver according to the present invention, respectively.

The color LED driver according to the present invention will be described with reference to FIGS. 3 to 5. First, in FIG. 3, the driving constant voltage source 100 according to the present invention supplies the predetermined driving constant voltage Vd to the driving circuit 200.

The driving circuit 200 converts the driving constant voltage VD of the driving constant voltage source 100 into the plurality of driving currents, for driving the color LEDs, and supplies the plurality of driving currents to the LEDs.

The temperature compensation unit 300 according to the present invention compensates variations in the red LED driving current Ird and the green LED driving current Igd due to the variation in the temperature, among the plurality of driving currents from the driving circuit 200.

The plurality of color LEDs included in the LED unit 400 according to the present invention are turned on by the driving currents from the temperature compensation unit 300 and the driving current from the driving circuit 200.

The temperature compensation unit 300 according to the present invention may be variously designed and two examples of the temperature compensation unit will be described with reference to FIGS. 4*a* and 4*b*.

Referring to FIG. 4*a*, the temperature compensation unit 300 includes the NTC thermistor TH20 and the linear compensation resistor R20 connected in parallel and the NTC thermistor TH20 compensates the red LED driving current Ird and the green LED driving current Igd from the driving circuit 200 according to the variation in the temperature.

At this time, the linearities of the red LED driving current Ird and the green LED driving current Igd are compensated by the linear compensation resistor R20.

Referring to FIG. 4*b*, when the temperature compensation unit 300 includes the first temperature compensation circuit 310 and the second temperature compensation circuit 320, the first temperature compensation circuit 310 includes the first NTC thermistor TH21 and the first linear compensation resistor R21. The first NTC thermistor TH21 compensates the red LED driving current Ird according to the variation in the temperature and the first linear compensation resistor R21 is connected to the first NTC thermistor TH21 in parallel to compensate the linearity of the red LED driving current Ird.

The second temperature compensation circuit 320 includes the second NTC thermistor TH22 and the second linear compensation resistor R22. The second NTC thermistor TH22 compensates the green LED driving current Igd according to the variation in the temperature and the second linear compensation resistor R22 is connected to the second NTC thermistor TH22 in parallel to compensate the linearity of the green LED driving current Igd.

The first NTC thermistor TH21 has the temperature sensitivity higher than that of the second NTC thermistor TH22.

The NTC thermistor has the negative temperature coefficient. The plurality of LEDs included in the LED unit 400 may be connected to each other in series or/and in parallel.

The number of LEDs may vary depending on the object and the size of the backlight and may be adjusted according to the level of a driving voltage. In a general LED having the driving current of several tens of mA, since a forward voltage VF has a relationship of VF(Red)<VF(Green)≅VF(Blue), the number of combinations of the LEDs which can be connected in series is determined by determining the constant voltage source. The level of the driving voltage may vary depending on an output of a power supply source of an upper module to be used or an additional driving integrated circuit (IC).

Referring to FIGS. 4*a* and 4*b*, since the luminance of the blue LED hardly varies depending on temperature, the blue LED is not compensated. A target current value for driving the RGB LEDs at a room temperature (25° C.) may be determined by a target white balance and RGB brightness ratio of the backlight through a current-voltage characteristic according to the temperature of the LED and efficiency and luminance characteristics according to the temperature.

At this time, referring to FIG. 4*b*, since a total resistance value of the red LEDs is R11+(R21//TH21) and a total resistance value of the green LEDs is R12+(R22//TH22), the total resistance value is determined by the target current value. When a target current value at the room temperature and a target current value at a high temperature (e.g., 80° C.) are determined, a difference between the total resistance values is calculated and thus the type of the NTC thermistor is determined.

Referring to FIGS. 5*a* and 5*b*, the characteristic graph of between the temperature and the resistance of the NTC thermistor is not linear, but the linearity is significantly improved by parallel connection between the NTC thermistor and the fixed resistor.

FIG. 5*a* shows a relative brightness variation ratio before and after the compensation of the temperature, and FIG. 5*b* shows a variation in driving current according to the compensation of the temperature.

As described above, according to the present invention, since a driving constant voltage is used, current varies depending on a resistance value of a load. At this time, when a temperature increases, a resistance value of an NTC thermistor according to the present invention decreases. Thus, the total resistance value decreases and thus the current increases. In this case, a driver must be designed in consideration of a phenomenon that a forward voltage of an LED decreases as a temperature increases.

According to the present invention, in a color LED driver used in an LCD backlight, since an NTC thermistor is directly connected to a driving current path of a color LED to compensate a characteristic variation of the LED due to a variation in a temperature, a feedback structure is not required and a small size and low cost can be accomplished.

That is, since the driver according to the present invention has a simpler configuration than that of a conventional LED driver using a constant current source and only passive elements including a fixed resistor and an NTC thermistor are inserted in a current path of the LED, instead of an operational amplifier circuit for controlling a base voltage of a transistor or a transistor driving structure for implementing the constant current source, it is possible to implement a simple backlight module and to easily match an interface with an upper module.

Since a feedback structure for receiving a signal from a temperature sensor is not included, the driver is easily designed without considering a relationship between a feedback signal and a temperature and accuracy of the feedback signal.

Since only the fixed resistor and the NTC thermistor are used, manufacturing cost is reduced and the driver according to the present invention is applicable as a small-sized chip component. Since the driver according to the present invention is miniaturized, space utilization is improved at the time of designing the backlight.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A color LED driver, comprising: a driving constant voltage source for supplying a predetermined driving constant voltage; a driving circuit for converting the driving constant voltage of the driving constant voltage source into a plurality of driving currents, for driving color LEDs, the plurality of driving currents including red LED driving current, green LED driving current and blue LED driving current; a temperature compensation unit, independent of the driving constant voltage source for directly compensating variations in the red LED driving current and the green LED driving current due to a variation in a temperature, among the plurality of driving currents from the driving circuit; and an LED unit including a plurality of color LEDs which are turned on by the driving currents from the temperature compensation circuit and the driving current from the driving circuit wherein the temperature compensation unit is connected between the driving circuit and the LED unit, such that the plurality of driving currents sequentially pass through the driving circuit, the temperature compensation unit and the LED unit.

2. The color LED driver according to claim 1, wherein the temperature compensation unit comprises:

an NTC thermistor for directly compensating the red LED driving current and the green LED driving current; and a linear compensation resistor which is connected to the NTC thermistor in parallel, for compensating linearity of the red LED driving current and the green LED driving current.

3. The color LED driver according to claim 1, wherein the LED unit 400 comprises:

a first LED unit 410 including a plurality of color LEDs and driven by one driving current;

a second LED unit 420 including a plurality of color LEDs and driven by another driving current; and a third LED unit 430 including a plurality of color LEDs and driven by the other driving current.

4. The color LED driver according to claim 3, wherein the first LED unit 410 includes the plurality of red LEDs and is driven by the red LED driving current Ird.

5. The color LED driver according to claim 3, wherein the second LED unit 420 includes the plurality of green LEDs and is driven by the green LED driving current Igd.

6. The color LED driver according to claim 3, wherein the third LED unit 430 includes the plurality of blue LEDs and is driven by the blue LED driving current Ibd.

7. The color LED driver according to claim 3, wherein each of the first, second and third LEDs 410, 420 and 430 includes at least two of a red LED, a green LED and a blue LED.

* * * * *